US007001095B1

(12) United States Patent
Chen

(10) Patent No.: US 7,001,095 B1
(45) Date of Patent: Feb. 21, 2006

(54) CLEANING BRUSH ASSEMBLY

(75) Inventor: Chin-Yuan Chen, Lu Kang Chen (TW)

(73) Assignee: Shin Tai Spurt Water of the Garden Tools Co., Ltd., Lu Kang Chen (TW)

( * ) Notice: Subject to any disclaimer, the term of this patent is extended or adjusted under 35 U.S.C. 154(b) by 0 days.

(21) Appl. No.: 10/883,268

(22) Filed: Jul. 1, 2004

(51) Int. Cl.
*A46B 11/06* (2006.01)
*A46B 11/04* (2006.01)
*A46B 11/00* (2006.01)

(52) U.S. Cl. ..... 401/289; 401/275; 401/281; 401/47

(58) Field of Classification Search ..... 401/270, 401/275, 280, 281, 289, 47
See application file for complete search history.

(56) References Cited

U.S. PATENT DOCUMENTS

| | | | | |
|---|---|---|---|---|
| 4,720,883 | A * | 1/1988 | Sanchez | 15/4 |
| 6,227,745 | B1 * | 5/2001 | Privett | 401/289 |
| 6,336,764 | B1 * | 1/2002 | Liu | 401/289 |
| 6,394,682 | B1 * | 5/2002 | Zhadanov et al. | 401/289 |

* cited by examiner

*Primary Examiner*—David J. Walczak
(74) *Attorney, Agent, or Firm*—Alan D. Kamrath; Nikolai & Mersereau, P.A.

(57) ABSTRACT

A cleaning brush assembly includes a control handle, an extension pipe mounted on a second end of the control handle, a angle adjustable pipe module mounted on the extension pipe, and a cleaning portion mounted on the angle adjustable pipe module. The control handle includes a connecting member, a control seat, a control shaft, a switch member, and a control valve. Thus, the cleaning water is introduced into the primary flow channel for flushing use and can also be mixed with the detergent in the primary flow channel for cleaning use by rotation of the control valve, thereby facilitating a user operating cleaning brush assembly.

14 Claims, 10 Drawing Sheets

CLEANING BRUSH ASSEMBLY

BACKGROUND OF THE INVENTION

1. Field of the Invention

The present invention relates to a cleaning brush assembly.

2. Description of the Related Art

A conventional cleaning brush comprises a control handle, a cleaning water source mounted on a first end of the control handle, a first control switch mounted on the control handle to control the cleaning water from the cleaning water source into the control handle, a detergent source mounted on a side of the control handle, a second control switch mounted on the control handle to control the detergent from the detergent source into the control handle, an extension pipe mounted on a second end of the control handle, an angle adjustable pipe mounted on the extension pipe, and a cleaning portion mounted on the angle adjustable pipe module. When in use, the cleaning water from the cleaning water source and the detergent from the detergent source are controlled by operation of the first control switch and the second control switch respectively to flow through the extension pipe and the angle adjustable pipe module into the cleaning portion for use.

However, the cleaning water source and the detergent source are controlled by the first control switch and second control switch respectively, so that a user has to operate the first control switch and second control switch respectively so as to use the cleaning water and the detergent, thereby causing inconvenience to the user in operation of the conventional cleaning brush.

SUMMARY OF THE INVENTION

The primary objective of the present invention is to provide a cleaning brush assembly that is operated easily and conveniently.

Another objective of the present invention is to provide a cleaning brush assembly, wherein the cleaning water is introduced into the primary flow channel for flushing use and can also be mixed with the detergent in the primary flow channel for cleaning use by rotation of the control valve, thereby facilitating a user operating cleaning brush assembly.

A further objective of the present invention is to provide a cleaning brush assembly, wherein the angle of the angle adjustable pipe module is adjusted by pressing the push knob, thereby facilitating the user adjusting the angle of the angle adjustable pipe module.

A further objective of the present invention is to provide a cleaning brush assembly, wherein the locking member is locked by the resting edges and the locking legs of the push knob, so that the locking member is directly driven by the push knob, thereby preventing the locking member from being jammed during the pressing action of the push knob.

Further benefits and advantages of the present invention will become apparent after a careful reading of the detailed description with appropriate reference to the accompanying drawings.

DETAILED DESCRIPTION OF THE INVENTION

Figure 1:
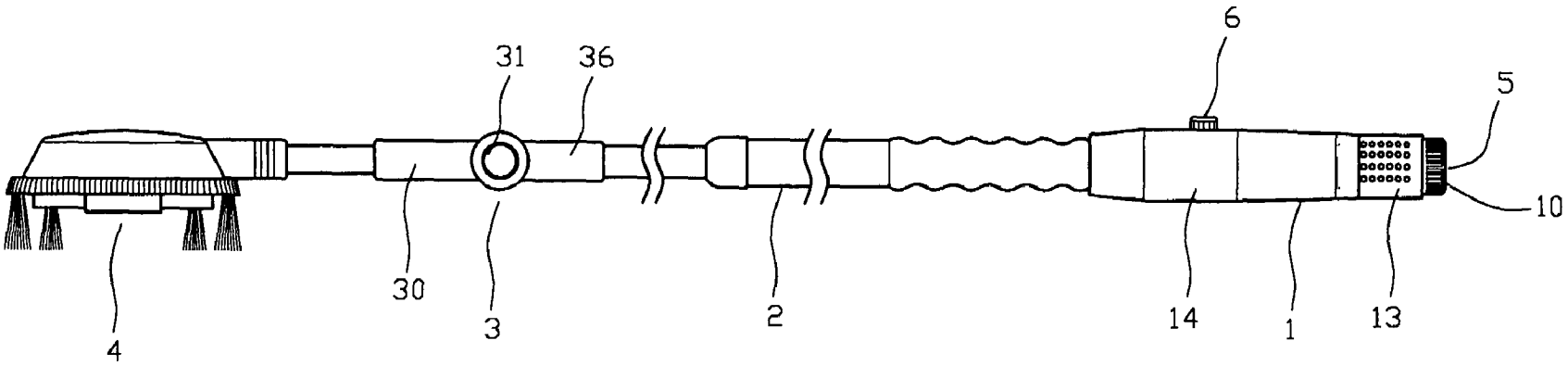
FIG. 1 is a plan view of a cleaning brush assembly in accordance with the preferred embodiment of the present invention.
Figure 2:
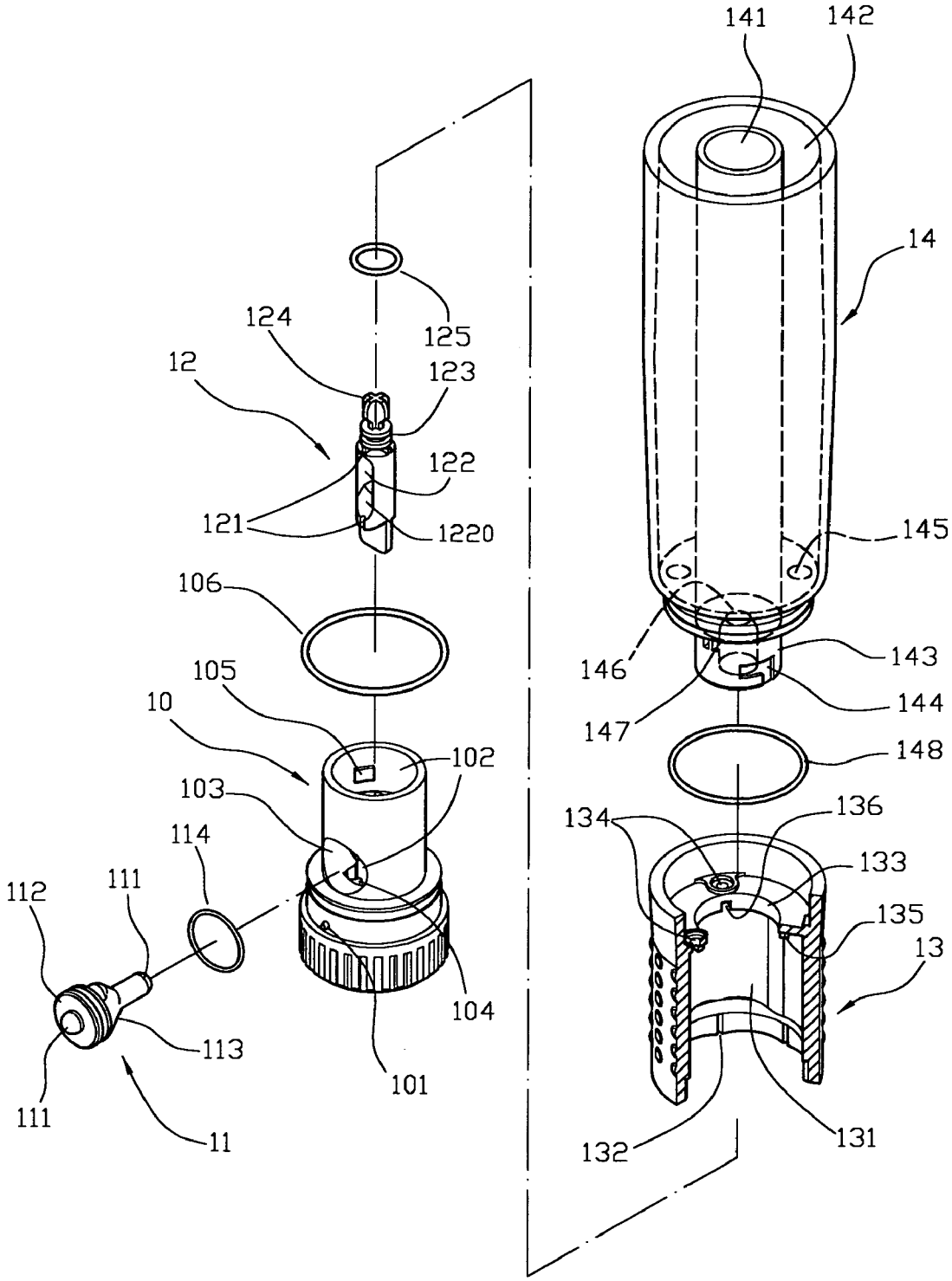
FIG. 2 is an exploded perspective view of a control handle of the cleaning brush assembly in accordance with the preferred embodiment of the present invention.
Figure 4:
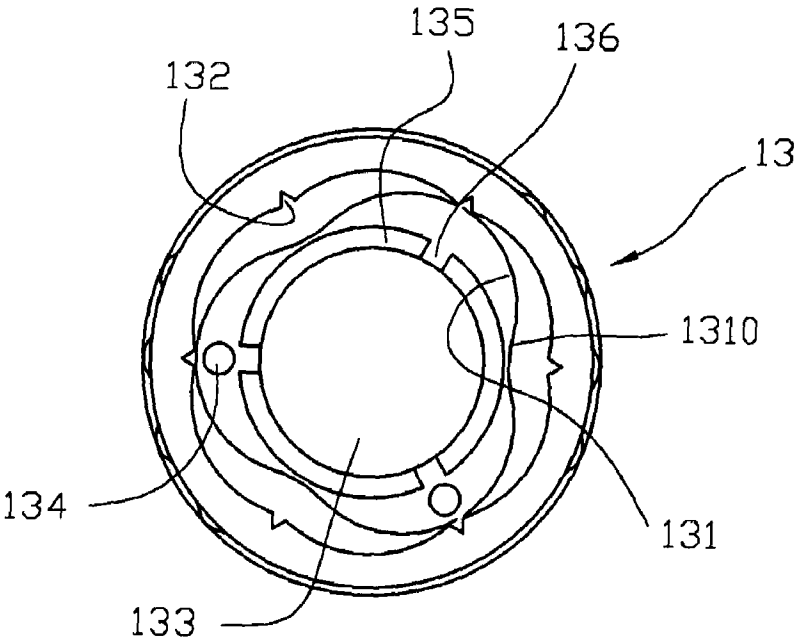
FIG. 4 is a plan cross-sectional view of a control valve of the control handle as shown in FIG. 2.
Figure 3:
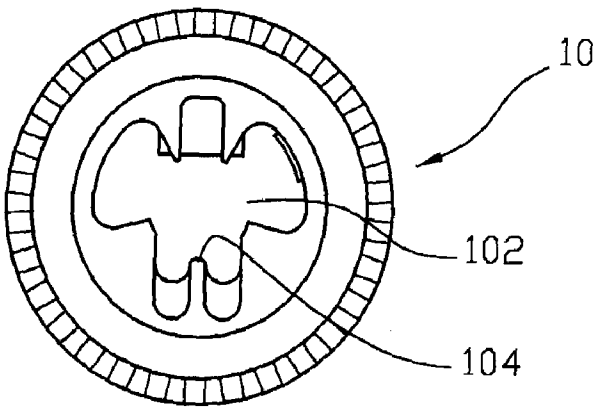
FIG. 3 is a plan cross-sectional view of a control seat of the control handle as shown in FIG. 2.

Referring to the drawings and initially to FIG. 1, a bendable cleaning brush assembly in accordance with the preferred embodiment of the present invention comprises a control handle 1, a cleaning water source 5 mounted on a first end of the control handle 1, a detergent source 6 mounted on a side of the control handle 1, an extension pipe 2 mounted on a second end of the control handle 1, an angle adjustable pipe module 3 mounted on the extension pipe 2, and a cleaning portion 4 mounted on the angle adjustable pipe module 3. When in use, the cleaning water from the cleaning water source 5 and the detergent from the detergent source 6 are controlled by operation of the control handle 1 to flow through the extension pipe 2 and the angle adjustable pipe module 3 into the cleaning portion 4 for use.

Referring to FIGS. 2–5, the control handle 1 includes a connecting member 14, a control seat 10, a control shaft 12, a switch member 11, and a control valve 13.

The connecting member 14 is connected to the extension pipe 2 and has an inside formed with a primary flow channel 141 having a periphery formed with a secondary flow channel 142 for passage of detergent. The connecting member 14 has a distal end formed with an insertion portion 143 and having an end face formed with a plurality of equally spaced filling holes 145 each communicating with the secondary flow channel 142. The insertion portion 143 of the connecting member 14 has an inside formed with a neck hole 146 communicating with the primary flow channel 141 and having a cylindrical reduced portion. The insertion portion 143 of the connecting member 14 has a periphery formed with a plurality of equally spaced filling bores 147 each communicating with the primary flow channel 141. The insertion portion 143 of the connecting member 14 has a distal end formed with a substantially inverted L-shaped locking slot 144.

The control seat 10 is secured on the insertion portion 143 of the connecting member 14 and has an inner wall formed with a passage 102 communicating with the primary flow channel 141 of the connecting member 14 and a periphery formed with a movable slot 103 communicating with the passage 102. The passage 102 of the control seat 10 has an end formed with a inward protruding locking block 105 locked in the locking slot 144 of the insertion portion 143 of the connecting member 14, so that the control seat 10 is secured on the insertion portion 143 of the connecting member 14. The passage 102 of the control seat 10 has a side formed with a guide rail 104. The control seat 10 has an outer wall provided with a retractable positioning boss 101.

The control shaft 12 is movably mounted in the control seat 10 in an axial direction of the control seat 10 and has an inside formed with a receiving slot 122 having a side formed with a tapered guide face 1220. The control shaft 12 has a side formed with a guide groove 121 mounted on the guide rail 104 of the control seat 10, so that the control shaft 12 is movable in the control seat 10 axially and linearly. The control shaft 12 has an end formed with a cylindrical stop portion 123 detachably inserted into the neck hole 146 of the connecting member 14 and a cross-shaped hollow guide portion 124 located beside the stop portion 123 and detachably inserted into the neck hole 146 of the connecting member 14. An O-ring 125 is mounted on the stop portion 123 of the control shaft 12 and urged on the neck hole 146 of the connecting member 14.

Figure 5:
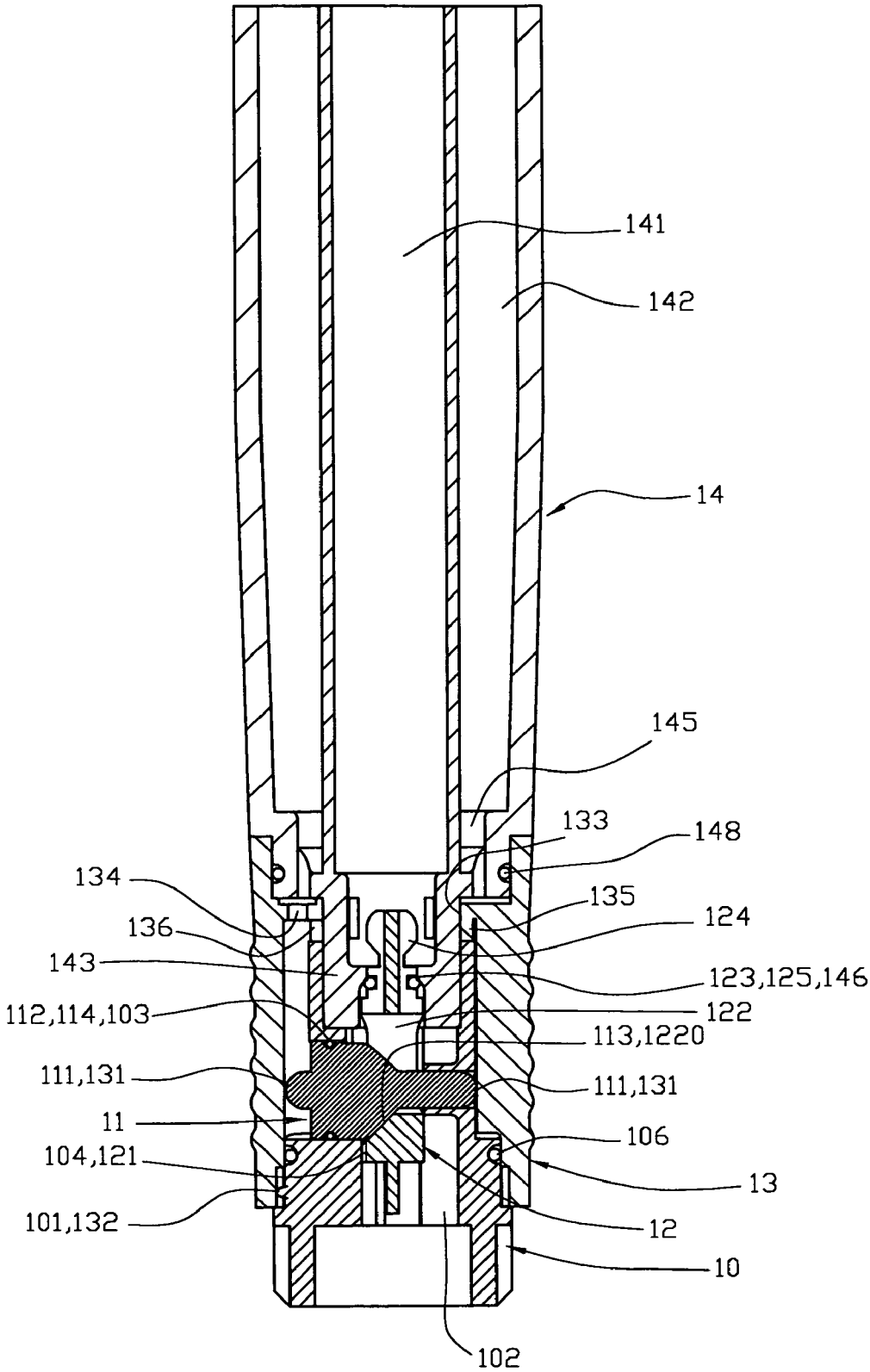
FIG. 5 is a plan cross-sectional assembly view of the control handle as shown in FIG. 2.
Figure 6:
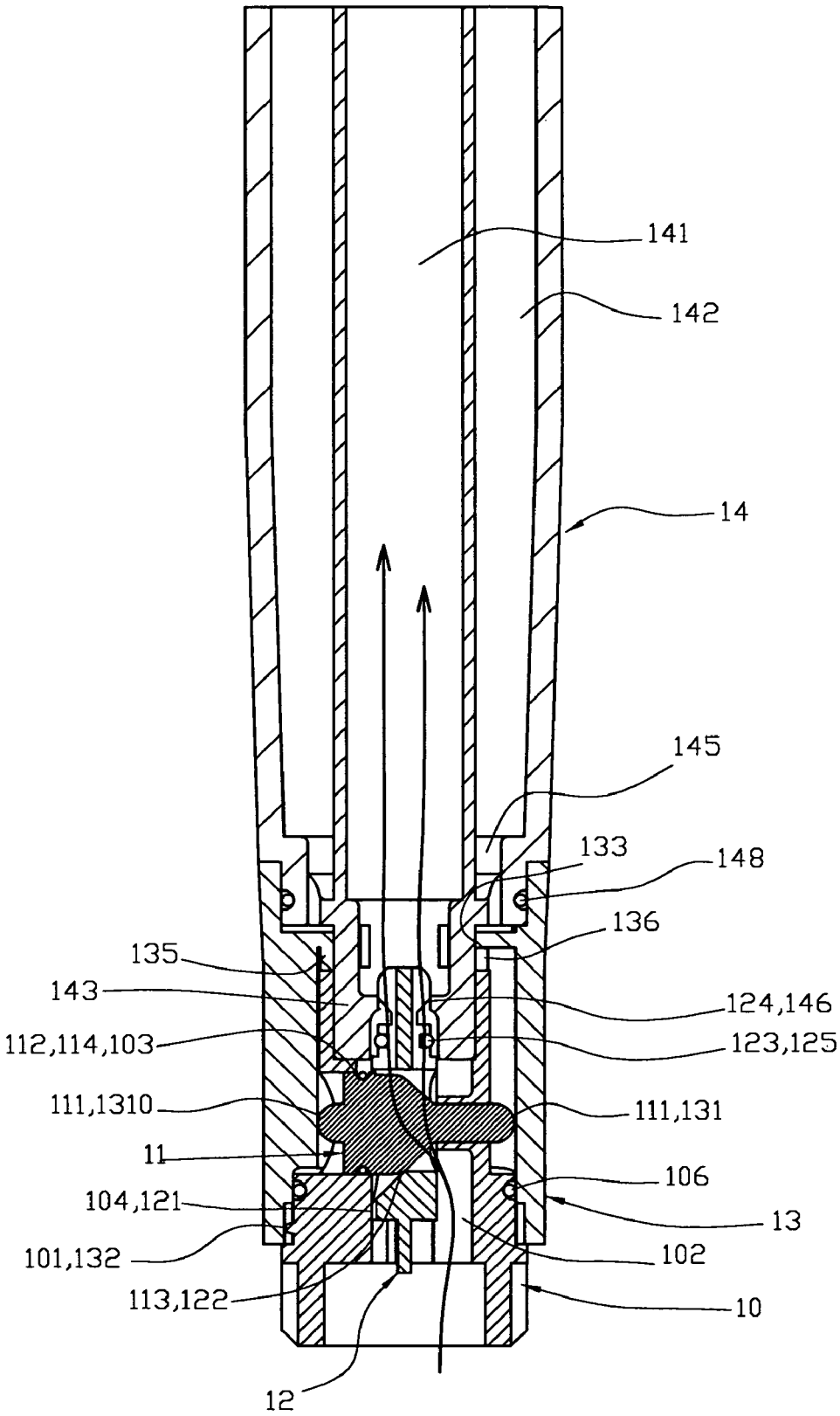
FIG. 6 is a schematic operational view of the control handle as shown in FIG. 5.

In practice, the control shaft 12 is movable in the control seat 10 between a first position where the stop portion 123 of the control shaft 12 is inserted into the neck hole 146 of the connecting member 14 as shown in FIG. 5 to interrupt the connection between the passage 102 of the control seat 10 and the primary flow channel 141 of the connecting member 14, and a second position where the guide portion 124 of the control shaft 12 is inserted into the neck hole 146 of the connecting member 14 as shown in FIG. 6 to connect the passage 102 of the control seat 10 to the primary flow channel 141 of the connecting member 14 through the guide portion 124 of the control shaft 12.

The switch member 11 is movably mounted in the control seat 10 in a radial direction of the control seat 10 and has two ends each formed with an arcuate driven portion 111 protruding outward from the periphery of the control seat 10. The switch member 11 has a periphery formed with a movable portion 112 movably mounted in the movable slot 103 of the control seat 10 and a tapered push portion 113 located beside the movable portion 112 and rested on the tapered guide face 1220 of the control shaft 12. An O-ring 114 is mounted on the movable portion 112 of the switch member 11 and urged on the movable slot 103 of the control seat 10.

When the switch member 11 is movable in the control seat 10, the tapered push portion 113 of the switch member 11 is moved to press the tapered guide face 1220 of the control shaft 12 as shown in FIG. 6 so as to move the control shaft 12 in the control seat 10.

The control valve 13 is rotatably mounted on the insertion portion 143 of the connecting member 14 and rotatable relative to the control seat 10. The control valve 13 has an inside formed with a control chamber 131 mounted on the control seat 10 and having a peripheral wall formed with a plurality of equally spaced corrugated urging portions 1310 (see FIG. 4) movably urged on the driven portion 111 of the switch member 11, so that when the control valve 13 is rotated relative to the control seat 10, the corrugated urging portions 1310 of the control valve 13 are moved to press the driven portion 111 of the switch member 11 as shown in FIG. 6 so as to move the switch member 11 in the control seat 10. The control chamber 131 of the control valve 13 has a first end formed with a through hole 133 mounted on the insertion portion 143 of the connecting member 14 and a second end formed with a plurality of equally spaced locking grooves 132 for positioning the positioning boss 101 of the control seat 10. The first end of the control chamber 131 of the control valve 13 has a periphery formed with a plurality of equally spaced filling holes 134 each communicating with the control chamber 131 and each aligning with a respective one of the filling holes 145 of the connecting member 14. The through hole 133 of the control valve 13 has a periphery formed with a protruding catch portion 135 formed with a plurality of equally spaced filling channels 136 each communicating with the control chamber 131 and each aligning with a respective one of the filling bores 147 of the connecting member 14. The catch portion 135 of the control valve 13 is rested on an end of the control seat 10.

An O-ring 148 is mounted on the distal end of the connecting member 14 and urged on an inner wall of the control valve 13. An O-ring 106 is mounted on the outer wall of the control seat 10 and urged on the inner wall of the control valve 13.

Figure 7:
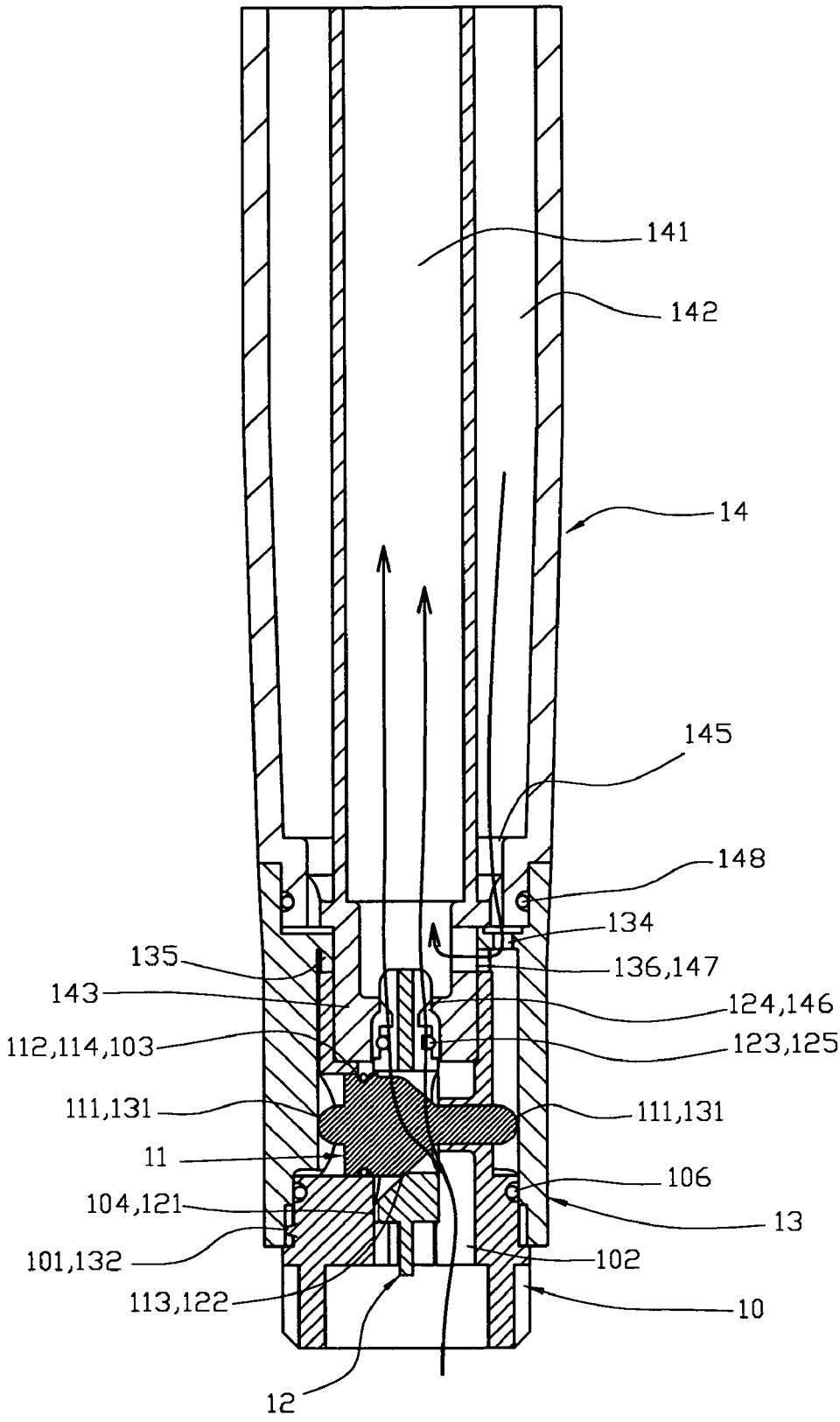
FIG. 7 is a schematic operational view of the control handle as shown in FIG. 6.

In operation, referring to FIGS. 5–7 with reference to FIGS. 1–4, the stop portion 123 of the control shaft 12 is initially inserted into the neck hole 146 of the connecting member 14 as shown in FIG. 5 to interrupt the connection between the passage 102 of the control seat 10 and the primary flow channel 141 of the connecting member 14 so as to stop the water flow.

Alternatively, when the control valve 13 is rotated relative to the control seat 10, the corrugated urging portions 1310 of the control valve 13 are moved to press the driven portion 111 of the switch member 11 as shown in FIG. 6 so as to move the switch member 11 in the control seat 10.

When the switch member 11 is moved in the control seat 10, the tapered push portion 113 of the switch member 11 is moved to press the tapered guide face 1220 of the control shaft 12 as shown in FIG. 6 so as to move the control shaft 12 in the control seat 10.

In such a manner, the control shaft 12 is moved downward in the control seat 10, so that the guide portion 124 of the control shaft 12 is inserted into the neck hole 146 of the connecting member 14 as shown in FIG. 6 to connect the passage 102 of the control seat 10 to the primary flow channel 141 of the connecting member 14 through the guide portion 124 of the control shaft 12. Thus, the cleaning water from the cleaning water source 5 flows through the passage 102 of the control seat 10, the neck hole 146 of the connecting member 14 and the guide portion 124 of the control shaft 12 into the primary flow channel 141 of the connecting member 14 as indicated by arrows shown in FIG. 6.

In addition, when the control valve 13 is further rotated relative to the control seat 10, the filling holes 134 of the control valve 13 align with the filling holes 145 of the connecting member 14, so that the detergent from the secondary flow channel 142 in turn flows through the filling holes 145 of the connecting member 14, the filling holes 134 of the control valve 13, the control chamber 131 of the control valve 13, the filling channels 136 of the control valve 13 and the filling bores 147 of the connecting member 14 into the primary flow channel 141 to mix with the cleaning water in the primary flow channel 141 of the connecting member 14 as indicated by arrows shown in FIG. 7.

Figure 8:
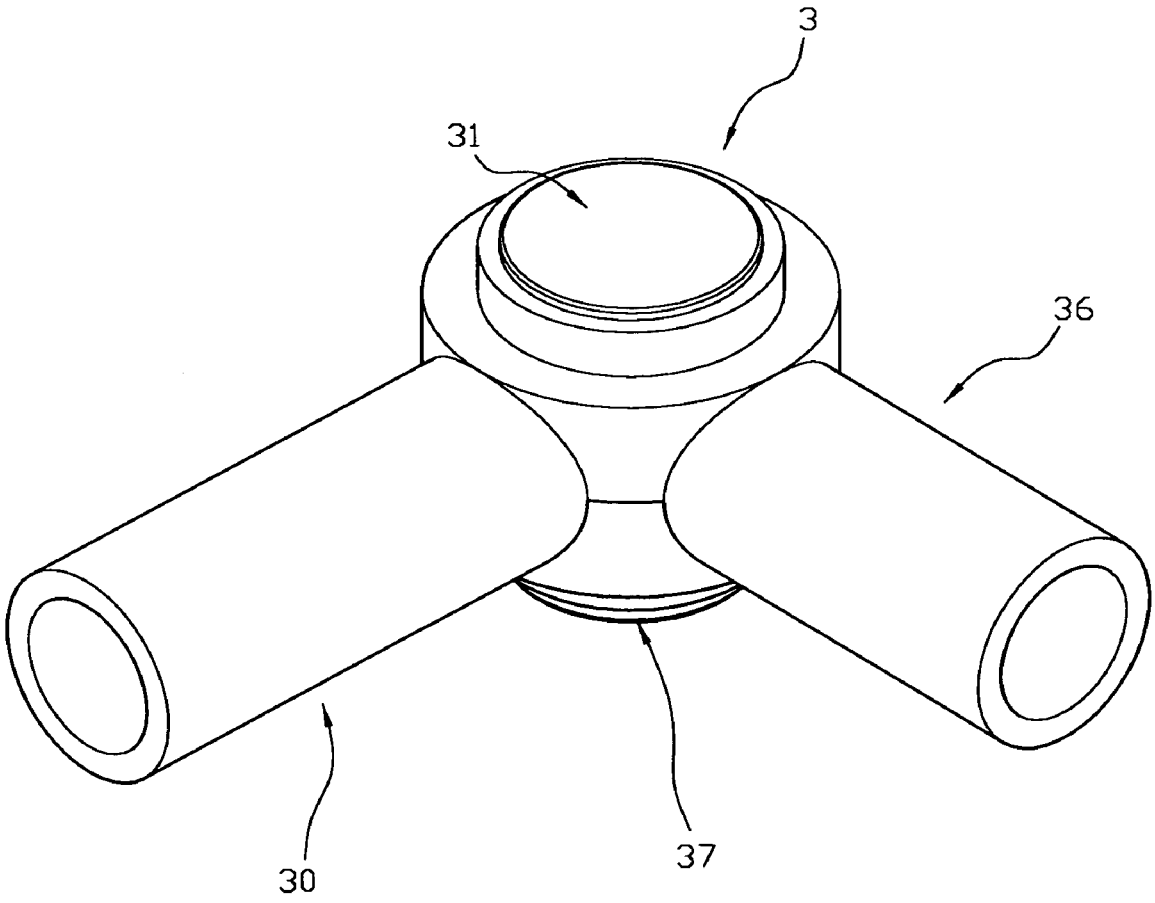
FIG. 8 is a perspective view of an angle adjustable pipe module of the cleaning brush assembly in accordance with the preferred embodiment of the present invention.
Figure 9:
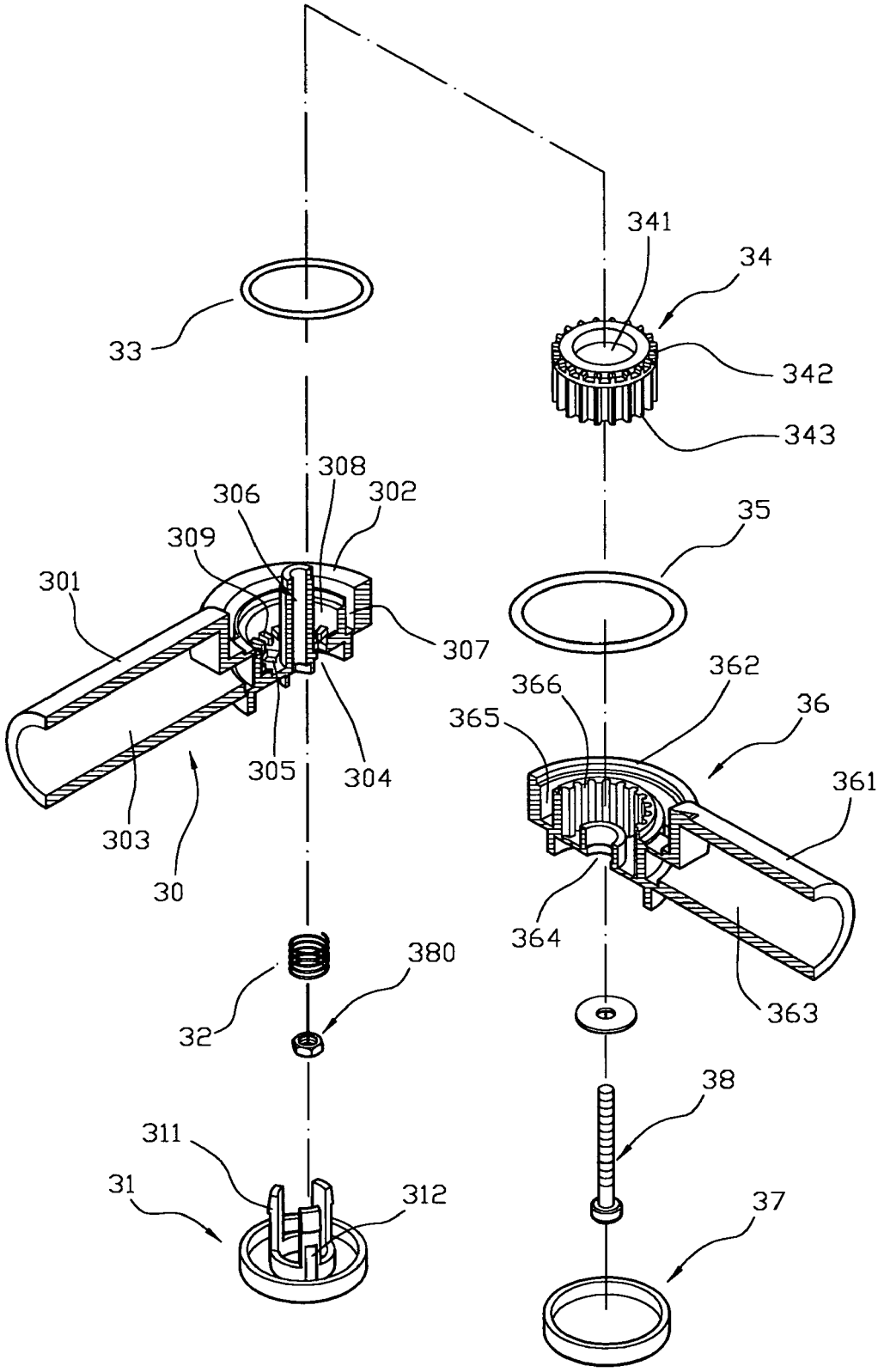
FIG. 9 is an exploded perspective view of the angle adjustable pipe module as shown in FIG. 8.
Figure 10:
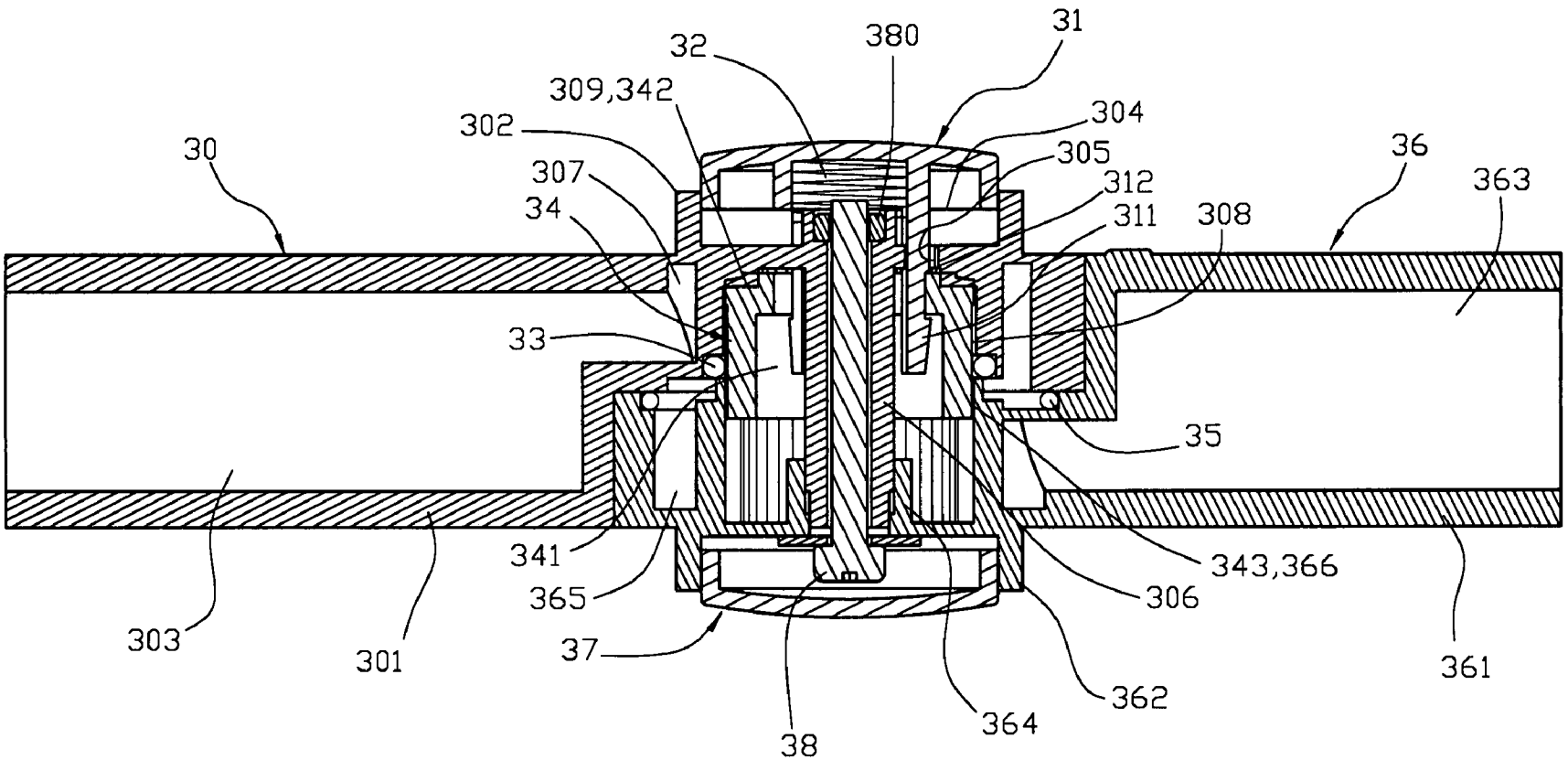
FIG. 10 is a plan cross-sectional view of the angle adjustable pipe module as shown in FIG. 8.

Referring to FIGS. 8–10, the angle adjustable pipe module 3 includes a first pipe 36 connected to the extension pipe 2, a second pipe 30 pivotally mounted on the first pipe 36 and connected to the cleaning portion 4, a locking member 34 mounted between the first pipe 36 and the second pipe 30 to detachably lock the second pipe 30 on the first pipe 36, and a push knob 31 movably mounted on the second pipe 30 and rested on the locking member 34 to move the locking member 34.

The first pipe 36 includes a first disk 362 having an inner wall formed with a toothed engaging recess 366 and an outer wall formed with an annular first water conducting groove 365, and a first connecting tube 361 mounted on a periphery of the first disk 362 and having an inside formed with a first water conducting channel 363 connected to the first water conducting groove 365 of the first disk 362. The first disk 362 of the first pipe 36 has a central portion formed with a pivot hole 364.

The second pipe 30 includes a second disk 302 pivotally mounted on the first disk 362 of the first pipe 36 and having an inner wall formed with a receiving recess 308 having a side provided with a plurality of locking teeth 309 and an outer wall formed with an annular second water conducting groove 307 communicating with the first water conducting groove 365 of the first pipe 36, and a second connecting tube 301 mounted on a periphery of the second disk 302 and having an inside formed with a second water conducting channel 303 connected to the second water conducting groove 307 of the second disk 302. The second disk 302 of the second pipe 30 has a central portion formed with a central post 306 pivotally mounted in the pivot hole 364 of the first pipe 36. The second disk 302 of the second pipe 30 has a side formed with a mounting recess 304 having a wall formed with a plurality of equally spaced through holes 305. An O-ring 35 is mounted in the first water conducting groove 365 of the first pipe 36 and urged on the second disk 302 of the second pipe 30.

A bolt 38 is extended through the central post 306 of the second pipe and rested on the first disk 362 of the first pipe 36, and a nut 380 is screwed onto the bolt 38 and rested on the second disk 302 of the second pipe 30 to combine the first pipe 36 with the second pipe 30. A side cover 37 is mounted on the first disk 362 of the first pipe 36 to cover the bolt 38.

The locking member 34 is movably mounted in the receiving recess 308 of the second pipe 30 and has an inner wall formed with a stepped locking hole 341. The locking member 34 has an outer wall having a first side formed with a toothed engaging portion 343 engaged in the engaging recess 366 of the first pipe 36 and a second side formed with a plurality of locking teeth 342 detachably meshing with the locking teeth 309 of the second pipe 30. An O-ring 33 is mounted in the receiving recess 308 of the second pipe 30 and urged on the locking member 34.

The push knob 31 is movably mounted in the mounting recess 304 of the second pipe 30 and has a side formed with a plurality of equally spaced locking legs 311 each extended through a respective one of the through holes 305 of the second pipe 30 and each locked in the locking hole 341 of the locking member 34. Each of the locking legs 311 of the push knob 31 has a side formed with a recessed resting edge 312 rested on the locking member 34 to move the locking member 34.

A spring 32 is mounted in the locking legs 311 of the push knob 31 and urged between the push knob 31 and the second disk 302 of the second pipe 30.

Figure 11:
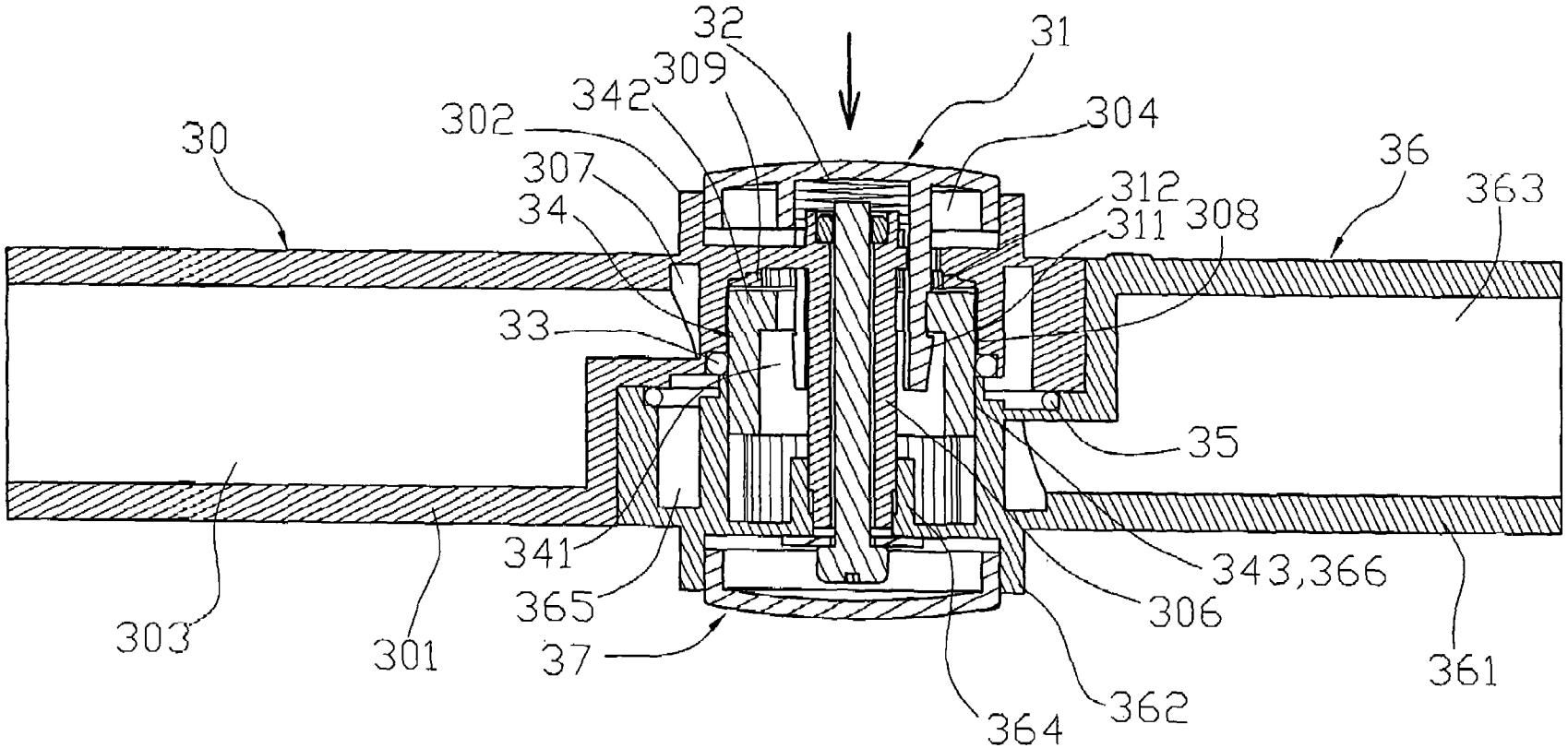
FIG. 11 is a schematic operational view of the angle adjustable pipe module as shown in FIG. 10.

In operation, referring to FIGS. 10 and 11 with reference to FIGS. 8 and 9, when the push knob 31 is pressed toward the second disk 302 of the second pipe 30, the resting edges 312 of the locking legs 311 of the push knob 31 is moved to push and move the locking member 34 toward the first disk 362 of the first pipe 36, thereby detaching the locking teeth 342 of the locking member 34 from the locking teeth 309 of the second pipe 30, so that the second pipe 30 is pivotable relative to the first pipe 36 so as to adjust the angle between the second pipe 30 and the first pipe 36 and to adjust the angle of the angle adjustable pipe module 3.

Accordingly, the cleaning water is introduced into the primary flow channel 141 for flushing use and can also be mixed with the detergent in the primary flow channel 141 for cleaning use by rotation of the control valve 13, thereby facilitating a user operating cleaning brush assembly. In addition, the angle of the angle adjustable pipe module 3 is adjusted easily and conveniently by pressing the push knob 31, thereby facilitating the user adjusting the angle of the angle adjustable pipe module 3. Further, the locking member 34 is locked by the resting edges 312 and the locking legs 311 of the push knob 31, so that the locking member 34 is directly driven by the push knob 31, thereby preventing the locking member 34 from being jammed during the pressing action of the push knob 31.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A cleaning brush assembly, comprising a control handle, a cleaning water source mounted on a first end of the control handle, a detergent source mounted on a side of the control handle, an extension pipe mounted on a second end of the control handle, an angle adjustable pipe module mounted on the extension pipe, and a cleaning portion mounted on the angle adjustable pipe module, wherein:

the control handle includes a connecting member, a control seat, a control shaft, a switch member, and a control valve, wherein:

the connecting member is connected to the extension pipe and has an inside formed with a primary flow channel having a periphery formed with a secondary flow channel, the connecting member has a distal end formed with an insertion portion and having an end face formed with a plurality of equally spaced filling holes each communicating with the secondary flow channel, the insertion portion of the connecting member has an inside formed with a neck hole communicating with the primary flow channel and has a periphery formed with a plurality of equally spaced filling bores each communicating with the primary flow channel;

the control seat is secured on the insertion portion of the connecting member and has an inner wall formed with a passage communicating with the primary flow channel of the connecting member;

the control shaft is movably mounted in the control seat in an axial direction of the control seat and has an inside formed with a receiving slot having a side formed with a tapered guide face, the control shaft has an end formed with a stop portion detachably inserted into the neck hole of the connecting member and a hollow guide portion located beside the stop portion and detachably inserted into the neck hole of the connecting member;

the switch member is movably mounted in the control seat in a radial direction of the control seat and has two ends each formed with an arcuate driven portion protruding outward from the periphery of the control seat, the switch member has a periphery formed with a tapered push portion rested on the tapered guide face of the control shaft;

the control valve is rotatably mounted on the insertion portion of the connecting member and rotatable relative to the control seat, the control valve has an inside formed with a control chamber mounted on the control seat and having a peripheral wall formed with a plurality of equally spaced corrugated urging portions movably urged on the driven portion of the switch member, the control chamber of the control valve has a first end having a periphery formed with a plurality of equally spaced filling holes each communicating with the control chamber and each aligning with a respective one of the filling holes of the connecting member, the first end of the control chamber of the control valve is formed with a through hole mounted on the insertion portion of the connecting member and having a periphery formed with a protruding catch portion formed with a plurality of equally spaced filling channels each communicating with the control chamber and each aligning with a respective one of the filling bores of the connecting member.

2. The cleaning brush assembly in accordance with claim 1, wherein the insertion portion of the connecting member has a distal end formed with a substantially inverted L-shaped locking slot, and the passage of the control seat has an end formed with a inward protruding locking block locked in the locking slot of the insertion portion of the connecting member, so that the control seat is secured on the insertion portion of the connecting member.

3. The cleaning brush assembly in accordance with claim 1, wherein the control seat has a periphery formed with a movable slot communicating with the passage, and the periphery of the switch member is formed with a movable portion movably mounted in the movable slot of the control seat.

4. The cleaning brush assembly in accordance with claim 1, wherein the passage of the control seat has a side formed with a guide rail, and the control shaft has a side formed with a guide groove mounted on the guide rail of the control seat, so that the control shaft is movable in the control seat axially and linearly.

5. The cleaning brush assembly in accordance with claim 1, wherein the control seat has an outer wall provided with a retractable positioning boss, and the control chamber of the control valve has a second end formed with a plurality of equally spaced locking grooves for positioning the positioning boss of the control seat.

6. The cleaning brush assembly in accordance with claim 1, wherein the control shaft is movable in the control seat between a first position where the stop portion of the control shaft is inserted into the neck hole of the connecting member to interrupt the connection between the passage of the control seat and the primary flow channel of the connecting member, and a second position where the guide portion of the control shaft is inserted into the neck hole of the connecting member to connect the passage of the control seat to the primary flow channel of the connecting member through the guide portion of the control shaft.

7. The cleaning brush assembly in accordance with claim 1, wherein the catch portion of the control valve is rested on an end of the control seat.

8. A cleaning brush assembly, comprising a control handle, a cleaning water source mounted on a first end of the control handle, a detergent source mounted on a side of the control handle, an extension pipe mounted on a second end of the control handle, an angle adjustable pipe module mounted on the extension pipe, and a cleaning portion mounted on the angle adjustable pipe module, wherein:

the angle adjustable pipe module includes a first pipe connected to the extension pipe, a second pipe pivotally mounted on the first pipe and connected to the cleaning portion, a locking member mounted between the first pipe and the second pipe to detachably lock the second pipe on the first pipe, and a push knob movably mounted on the second pipe and rested on the locking member to move the locking member;

the first pipe includes a first disk having an inner wall formed with a toothed engaging recess and an outer wall formed with an annular first water conducting groove, and a first connecting tube mounted on a periphery of the first disk and having an inside formed with a first water conducting channel connected to the first water conducting groove of the first disk;

the second pipe includes a second disk pivotally mounted on the first disk of the first pipe and having an inner wall formed with a receiving recess having a side provided with a plurality of locking teeth and an outer wall formed with an annular second water conducting groove communicating with the first water conducting groove of the first pipe, and a second connecting tube mounted on a periphery of the second disk and having an inside formed with a second water conducting channel connected to the second water conducting groove of the second disk; and the locking member is movably mounted in the receiving recess of the second pipe and has an outer wall having a first side formed with a toothed engaging portion engaged in the engaging recess of the first pipe and a second side formed with a plurality of locking teeth detachably meshing with the locking teeth of the second pipe.

9. The cleaning brush assembly in accordance with claim 8, wherein the first disk of the first pipe has a central portion formed with a pivot hole, and the second disk of the second pipe has a central portion formed with a central post pivotally mounted in the pivot hole of the first pipe.

10. The cleaning brush assembly in accordance with claim 8, wherein the second disk of the second pipe has a side formed with a mounting recess having a wall formed with a plurality of equally spaced through holes, the locking member has an inner wall formed with a stepped locking hole, and the push knob is movably mounted in the mounting recess of the second pipe and has a side formed with a plurality of equally spaced locking legs each extended through a respective one of the through holes of the second pipe and each locked in the locking hole of the locking member.

11. The cleaning brush assembly in accordance with claim 10, wherein each of the locking legs of the push knob has a side formed with a recessed resting edge rested on the locking member to move the locking member.

12. The cleaning brush assembly in accordance with claim 10, wherein the angle adjustable pipe module further includes a spring mounted in the locking legs of the push knob and urged between the push knob and the second disk of the second pipe.

13. The cleaning brush assembly in accordance with claim 9, wherein the angle adjustable pipe module further includes a bolt extended through the central post of the second pipe and rested on the first disk of the first pipe, and a nut is screwed onto the bolt and rested on the second disk of the second pipe to combine the first pipe with the second pipe.

14. The cleaning brush assembly in accordance with claim 13, wherein the angle adjustable pipe module further includes a side cover mounted on the first disk of the first pipe to cover the bolt.

* * * * *